US008166602B2

(12) United States Patent
Paterson

(10) Patent No.: US 8,166,602 B2
(45) Date of Patent: May 1, 2012

(54) GUTTER CLEANER APPARATUS, A GUTTER CLEANER KIT AND A METHOD OF CLEANING GUTTERS

(76) Inventor: Michael Stephen Paterson, Salisbury Downs (AU)

( * ) Notice: Subject to any disclaimer, the term of this patent is extended or adjusted under 35 U.S.C. 154(b) by 644 days.

(21) Appl. No.: 12/412,997

(22) Filed: Mar. 27, 2009

(65) Prior Publication Data

US 2009/0249575 A1 Oct. 8, 2009

(30) Foreign Application Priority Data

Mar. 27, 2008 (AU) ..... 2008901517

(51) Int. Cl.
*E04D 13/076* (2006.01)

(52) U.S. Cl. ..... 15/236.04; 15/144.1; 15/145

(58) Field of Classification Search ..... 15/236.01, 15/236.04, 257.01, 264, 144.1, 145
See application file for complete search history.

(56) References Cited

FOREIGN PATENT DOCUMENTS

WO WO 2007/002983 * 1/2007
* cited by examiner

*Primary Examiner* — Laura C Guidotti
(74) *Attorney, Agent, or Firm* — Renner Kenner Greive Bobak Taylor & Weber

(57) ABSTRACT

A cleaning arrangement for removing accumulated leaves and other debris from an overhead gutter of a building, said arrangement including: a cleaning tool having a blade of comparative cross sectional profile to the gutter to be cleaned, an elongated rod having one end adapted to be held by a user and a remote end substantially perpendicular to the said blade when blade is connected to said rod, said blade including an aperture at an upper corner of said blade for an end of the rod to be releasable fastenable therein, such that the off-centering of the rod to the corner of the blade allows the cleaning tool to be scraped along the length of a segment of guttering without the blade making contact with internal brackets or bracing supporting the gutter.

9 Claims, 13 Drawing Sheets

GUTTER CLEANER APPARATUS, A GUTTER CLEANER KIT AND A METHOD OF CLEANING GUTTERS

TECHNOLOGICAL FIELD

This invention relates to an apparatus for removing accumulated leaves or other debris from overhead gutters of a building or the like, but particularly a gutter cleaner kit includes an improved hand held apparatus or tool which may conveniently be used by a user to efficiently clean leaves and other debris from the overhead gutters of a home or similar such premises.

This invention also provides for an improved method of cleaning debris from gutters utilising the improved cleaning kit referred to above.

BACKGROUND ART

U.S. Pat. No. 4,542,553 provides for a tool for cleaning gutters which has a singular rod like member to which is attached a plate adjacent to one end and a handle adjacent to the other, and which is so configured that the plate could be scraped along the trough of the gutter.

As stated in the specification for U.S. Pat. No. 4,542,553 the gutter cleaning tool has the rod which joins the scraping blade and handle together divided into two sections by a fold such that the rod itself is substantially perpendicular to the flat face of the scraping blade.

As can be seen from FIG. 1 of U.S. Pat. No. 4,542,553 the scraping blade or plate sits symmetrically below the interconnecting rod.

While such a tool for cleaning gutters may have had some applicability in 1985 this current design is deficient for a variety of reasons, now in the twenty first century.

Firstly, gutters are now supported and connected to the roof via a variety of internal brackets which would mean for the most part that the cleaning tool provided for in U.S. Pat. No. 4,542,553 would collide with these brackets making it difficult to scrape the cleaning tool along the length of the gutter. Or at least any scraping would in fact be interrupted providing inconvenience and trouble to the user.

Such difficulties are exasperated when a user is upon a ladder several metres up from ground level where safety and convenience would be paramount.

As the person skilled in the art would appreciate if the cleaning tool is only allowed to be scraped over very small sections of guttering to avoid these internal brackets which assist in fixing the gutters appropriately to the roof, the user will have to regularly climb up and down the ladder to move to the next portion.

The cleaning tool provided for in U.S. Pat. No. 4,542,553 when applied to modern day designed gutters would not allow a user to conveniently scrape long segments or lengths off gutters to remove the leaves, debris and the like.

Still further, as the rod is fixed to the blade in the central point of said blade, the user is unable to conveniently use the tool effectively, trouble free and conveniently in both hands. What this means is that the blade which connects to the cleaning tool rod in U.S. Pat. No. 4,542,553 if reversed, still has no ability for either cleaning tool per se to be used by the same preferred hand of the user when cleaning the gutter.

It would be most advantageous to be able to design a scraping blade such that it could be reversed or the like so that the cleaning tool could be used by the users preferred hand once positioned on the ladder to clean segments of the gutter both to the left and right side of the user.

This would be a significant advantage as the user once positioned on the ladder could clean a much longer length of guttering before the ladder position would need to be changed.

Hence there remains a need in the relevant field of cleaning gutters of a tool, apparatus and or kit that is more ergonomically designed to allow the cleaning head or blade of the cleaning tool to pass easily under the bracing such that a single cleaning action of a user can extend across a greater segment of length of the gutter.

Still further there is a requirement to still provide in this relevant field of technology an improved cleaning tool for gutters such that the blade which is responsible for collecting the leaves and the debris allows passage under these internal brackets of the gutter but also be designed to more specifically match the profile of common gutters of the twenty first century as well as allow simple removability of the blade or head for detachability and reversibility so that the cleaning tool can be used in the preferred hand of the user while positioned on the ladder irrespective of whether leaves and debris need to be scraped from either the left or the right side of the ladder.

SUMMARY OF THE INVENTION

Accordingly in one form of the invention there is provided a cleaning tool for removing accumulated leaves and other debris from an overhead gutter of a building, said tool including:

- a blade of comparative cross sectional profile to the gutter to be cleaned,
- an elongated handle having one end adapted to be held by a user and a remote end substantially perpendicular to the said blade,
- said blade including an aperture at an upper corner of said blade for an end of the handle to be releasable fastenable therein,
- such that the off-centering of the securable detachable rod to the corner of the blade allows the cleaning tool to be scraped along the length of a segment of guttering without the blade and or rod making contact with internal brackets or bracing supporting the gutter.

An advantage of such an arrangement is that by having the blade to be able to be clipped or snapped on to the rod at the upper corner of the blade means that the blade or head can be conveniently secured to the rod.

Hence a selection of heads could be incorporated as part of an apparatus for the cleaning kit wherein the user would select the most appropriate head or blade configuration, which would conform with the same designs as to the gutter being cleaned.

As the head or blade can be conveniently snapped on and fitted to the rod when positioned on the roof the user can simply unclip or lock the blade and head and turn it around the other way such that it will allow the user to maintain using its preferred hand when the other side needs to be cleaned.

Hence the blade and head provide reversibility which in effect means that the user when positioned on the ladder can effectively clean both sides of the gutter from the perspective of the positioned central ladder using a single preferred hand.

A further advantage of such an arrangement is that as the rod is connected to the blade by this securable detachable snap fit connection in the upper corner, as there is no raised height of the rod on the central part of the blade means that as the blade scrapes along or brushes along the gutter and comes across the internal bracing or brackets of the gutter, with these particular brackets always being inclined, the rod is able to pass under the internal bracing or brackets without any abutment or discomfort to the user.

In preference the cleaning tool is made from a single piece of molded reinforced plastic to which for the most part the rod would include a defined groove along its length thereby minimizing the amount of material that needs to be utilized in the tool thereby keeping manufacturing costs and the weight of the product significantly reduced.

In order to appreciate fully the variety of advantages and benefits this new gutter cleaner apparatus includes as well as the associated gutter cleaning kit and the method of cleaning the gutters, a series of illustrations in an accompanying text now follow herewith.

BRIEF DESCRIPTION OF THE INVENTION

FIG. 1*a* is a perspective view of the gutter cleaner tool and FIG. 1*b* is a underside perspective view.

FIG. 2 is a front perspective view, partly in cross section, showing the close up of the blade being clipped on or snapped on to the rod in its off centred position to allow it to be conveniently passed under the internal bracing or brackets of the gutter.

FIGS. 3*a* and 3*b* shows schematic illustrations whereby the ability to reversibly easily detach and then secure the blade onto the rod means that the user of the tooling is able to maintain the use of their preferred hand for the cleaning of both the left and right side lengths of the guttering when in position.

FIG. 4 shows a further preferred embodiment of the invention of introduction of the feature of the scoop or spade.

FIGS. 5*a*, 5*b*, 5*c*, 5*d* and 5*e* show how the scoop or blade is designed to allow the user to easily reach into difficult areas located under the roofline to collect the debris that has been swept or scraped into position by the cleaning tool.

DETAIL DESCRIPTION OF THE INVENTION

Figure 1A:
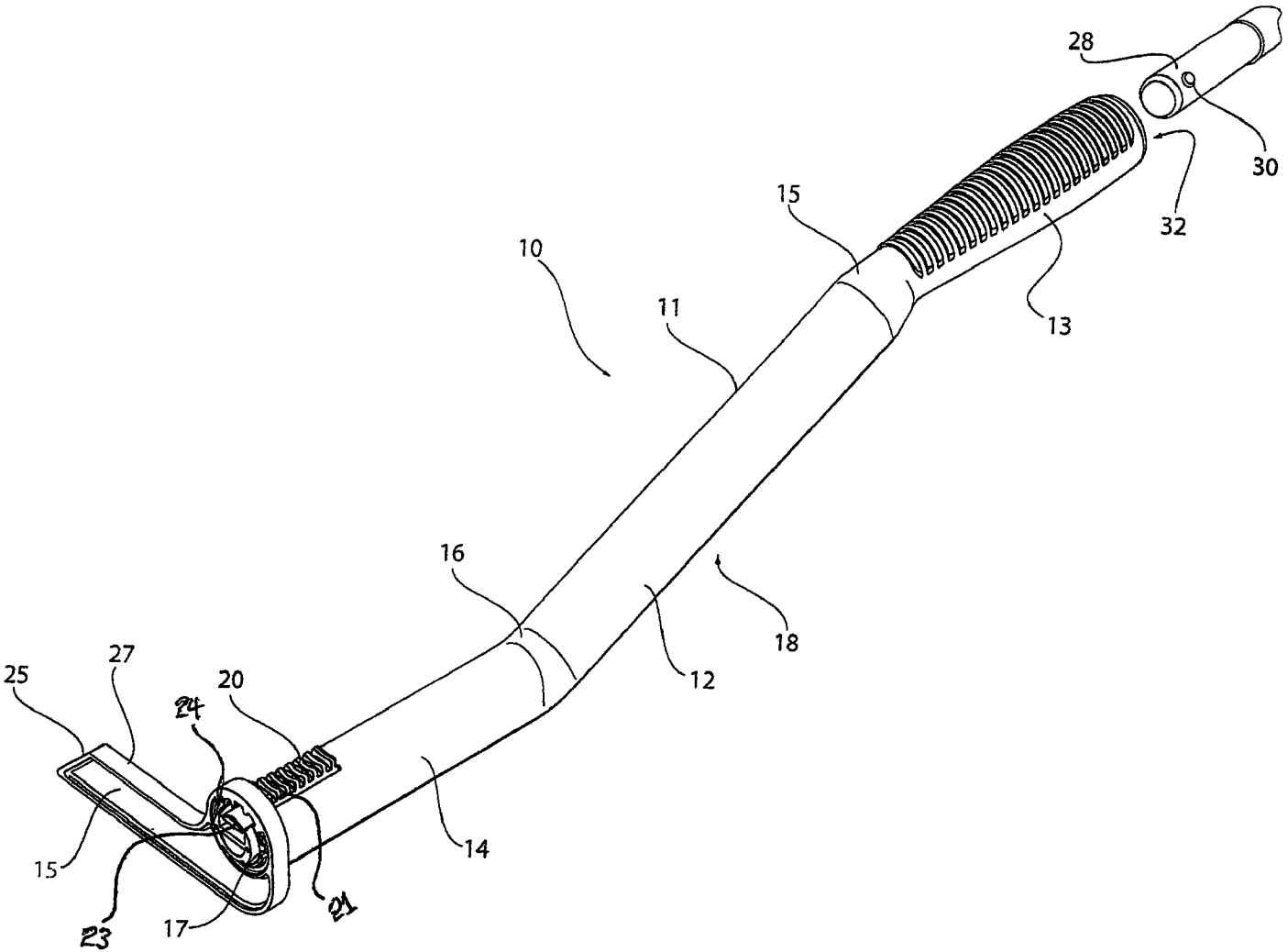
Figure 1B:
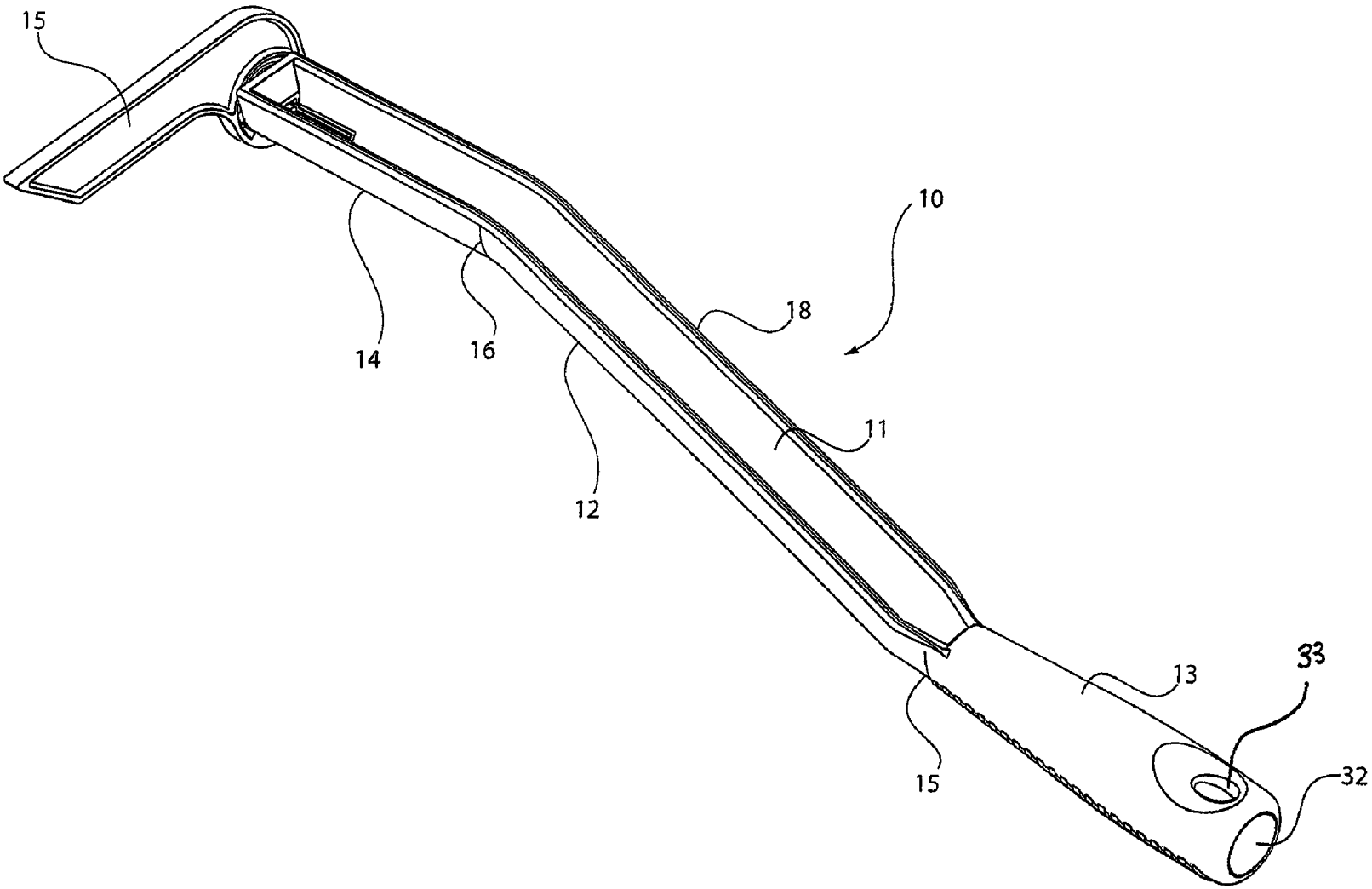

Referring to the drawings now in greater detail as shown in FIGS. 1*a* and 1*b* the cleaning tool 10 is made from reinforced plastic, preferably injection molded polypropylene being made up of a central rod shown generally as 11 divided into two sections 12 and 14 by fold 16. Handle 13 extends from the rod segment 12 by virtue of fold 15.

Advantageously by having the gutter cleaner manufactured using engineered grade polypropylene and preferably strengthened with glass fibre this will provide long term strength, durability and ultra violet sunlight resistance to the tool.

Still further the use of the reinforced plastic for the tooling has enabled the design to be not only functional to conform with the designs of the guttering but also aesthetically pleasing.

The defined groove 18 along the length of the rod 11 means that the level of plastics used can be reduced without consequence of durability but also to improve the lightness of the product which provides advantages in use when cleaning of the guttering is required.

Still further the selection of reinforced plastic as opposed to steel blades which are prominent in the prior art means that there is no damage caused by the cleaning tool to the guttering while being cleaned. For example there is no scraping or cutting of the gutter during the cleaning process.

Blade 15 is able to be snapped on to the lower end of the rod 14 by virtue of an aperture 17 which is positioned in the upper corner of the blade 15.

A biasing lever 20 extends into the aperture 17, wherein shelf 23 extending from the lever 20 includes an upward tab 25 that can be positioned into anyone of slots 24, depending on the angle to which a user wants the blade 15 relative to the rod 11. When in position tabs 22 abut shoulders 22 of the shelf 23 to prevent any unwanted rotation of the rod 11 in the aperture 17, while ribs 21 or the lever prevent any later movement of the blade 15 away from rod 11.

The blade or head 15 includes upper edge 27 as well as tapered or inclined side edge 25.

Figure 2:
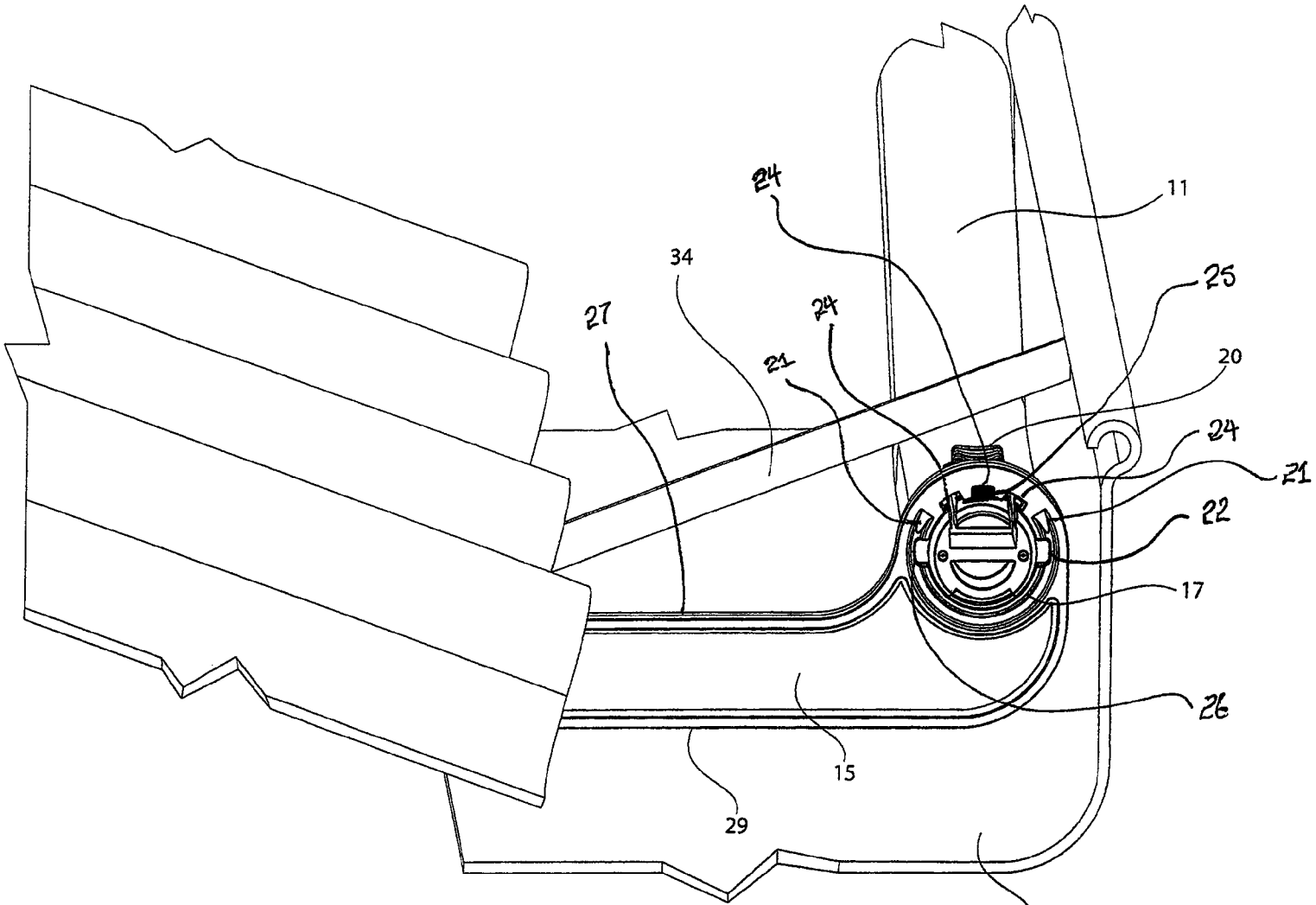

As can be seen in FIG. 2 by having the rod 11 connected to the blade 15 at the upper corner means that the internal bracing or brackets 34 present in the gutter 36 can be swept under without abutting contact.

In the prior art the rod was always connected central to the blade so as it is swept along a length of the guttering it will come in direct contact with the internal bracing or brackets 34 which help support the guttering in place on the roof.

The simple clip on effect between the rod 11, blade 15 and aperture 17, means that the blade can be snap on in reverse so that the preferred hand of the user can always be maintained.

Advantageously also as the blades 15 are snapped on a variety of different blades 15 can be provided for in the overall kit to suit most commonly available gutter profiles.

Figure 3A:
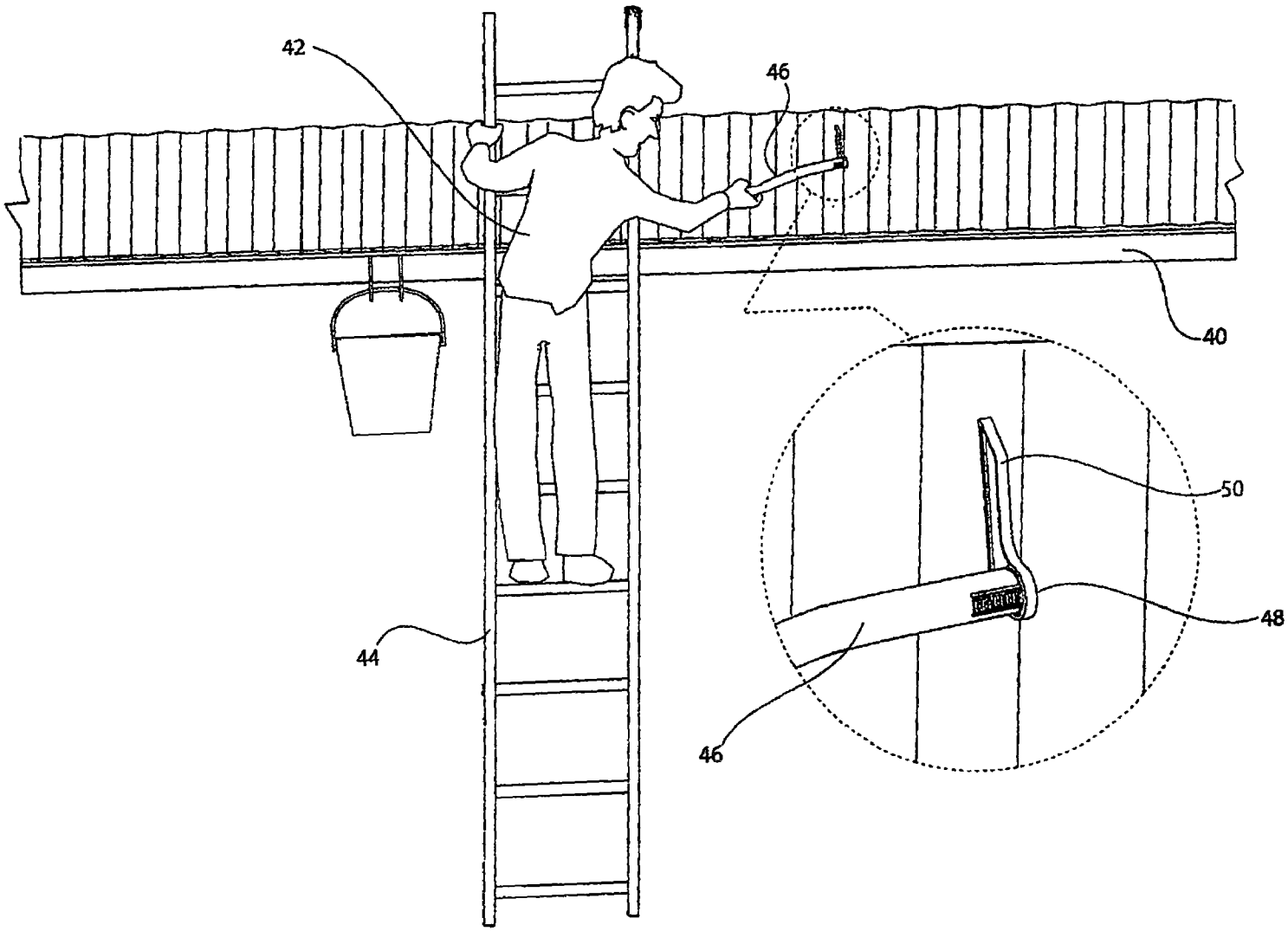
Figure 3B:
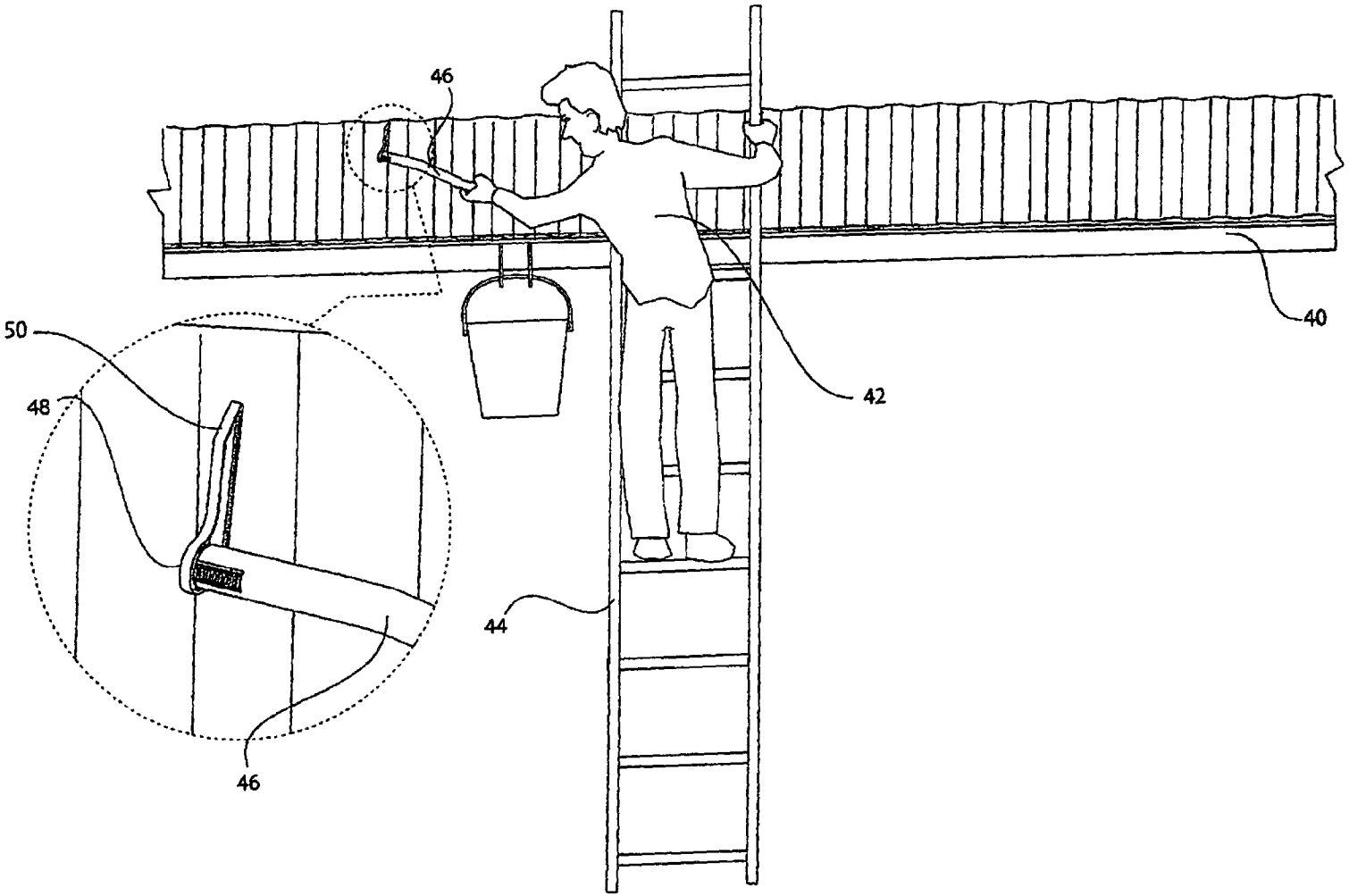

FIGS. 3*a* and 3*b* simply represents a schematic example of how the gutter 40 may be cleaned by user 42 who has scaled a ladder 44 to position his or herself such that the rod 46 connected in the upper right hand corner 48 of the blade 50 can then be appropriately used to clean both the right and left side length of the gutter 40.

Advantageously with this invention the head or blade 50 can be clipped off and then snapped fastenably back on for reversibility to allow the user to maintain use of their preferred hand when cleaning the entire length of the guttering from their elevated position on the ladder 44.

It also needs to be pointed out that the cleaning tool 10 includes aperture 32 which can allow an extended rod 28, of which itself said rod can be telescopically extended and retracted but includes a tab 30 which can clip in position within aperture 33 such that the extended rod 28 can remain fastened to rod 11 of the cleaning tool.

Advantageously as to be seen by this arrangement while the cleaning tool can be used as a hand held item it can also be held for an extended rod 28 by virtue of the locking mechanism provided for by features 30 and 33.

Advantageously the use of the extended rod 28 means that larger sections or lengths of the guttering can be cleaned from the one elevated position of the user upon a ladder.

Figure 4:
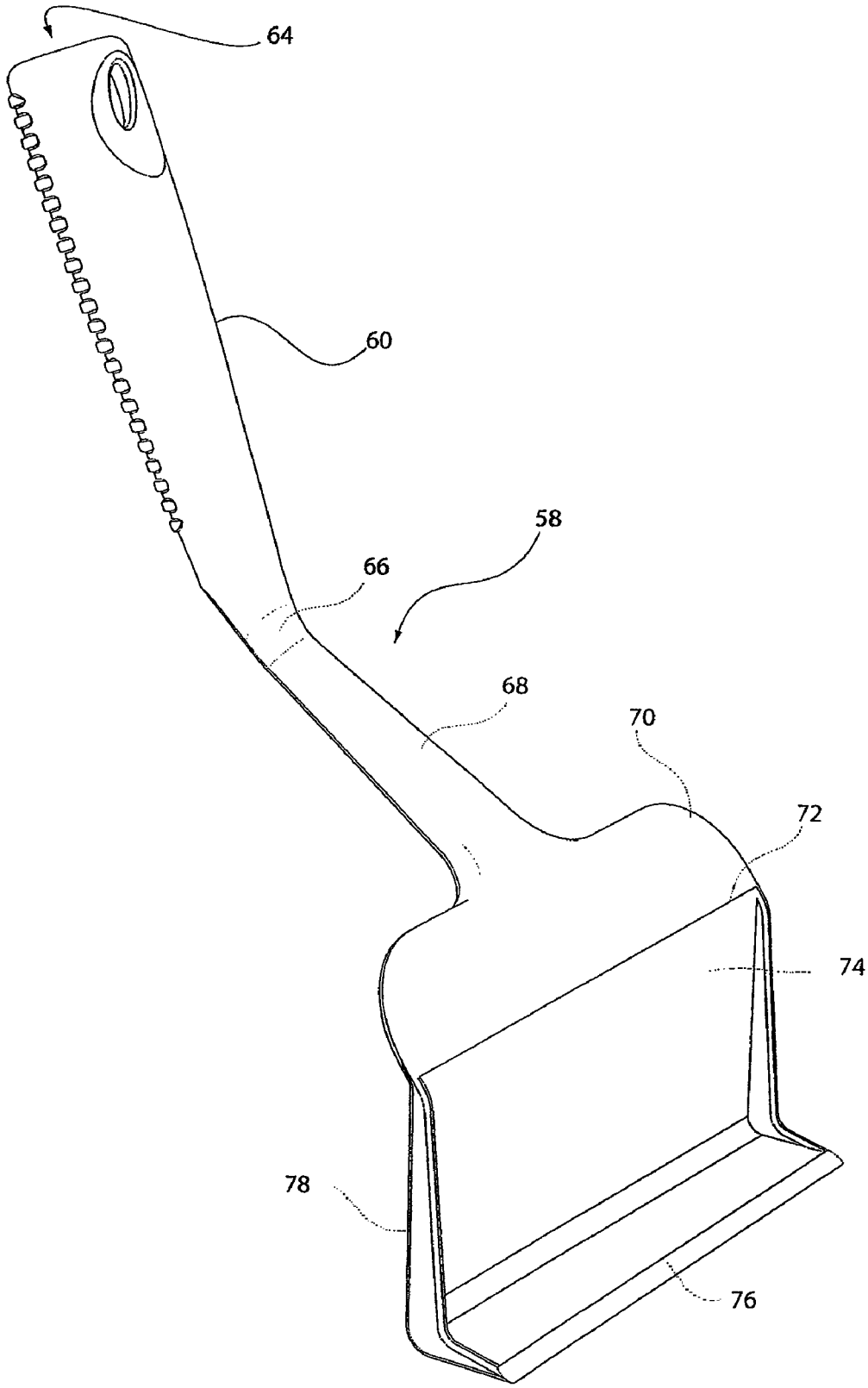

In FIG. 4 a scoop or shovel or spade 58 is provided for which has a handle 60, a fold 66, length 68, shoulder 70, fold 72, platform 74 as well as a base 76 which is joined together by raised shoulder 78.

FIGS. 5*a* to 5*e* show schematically how this scoop 58 can be used to assist in the overall cleaning of the guttering.

The unique design of the scoop 58 allows the user to easily reach normally hard to reach areas such as under the roofline. The shape and design of the scoop 58 allows the debris collected by the blade 15 of the cleaning tool 10 to be easily lifted out of the gutter and into a bucket or the like as strategically placed next to the gutter and discussed in slightly further detail in relation to FIG. 7.

The scoop 58 also may include aperture 64 as well as a configured design to allow a handle or the like to extend thereinto shown generally as 62 in the illustrations.

Figure 5A:
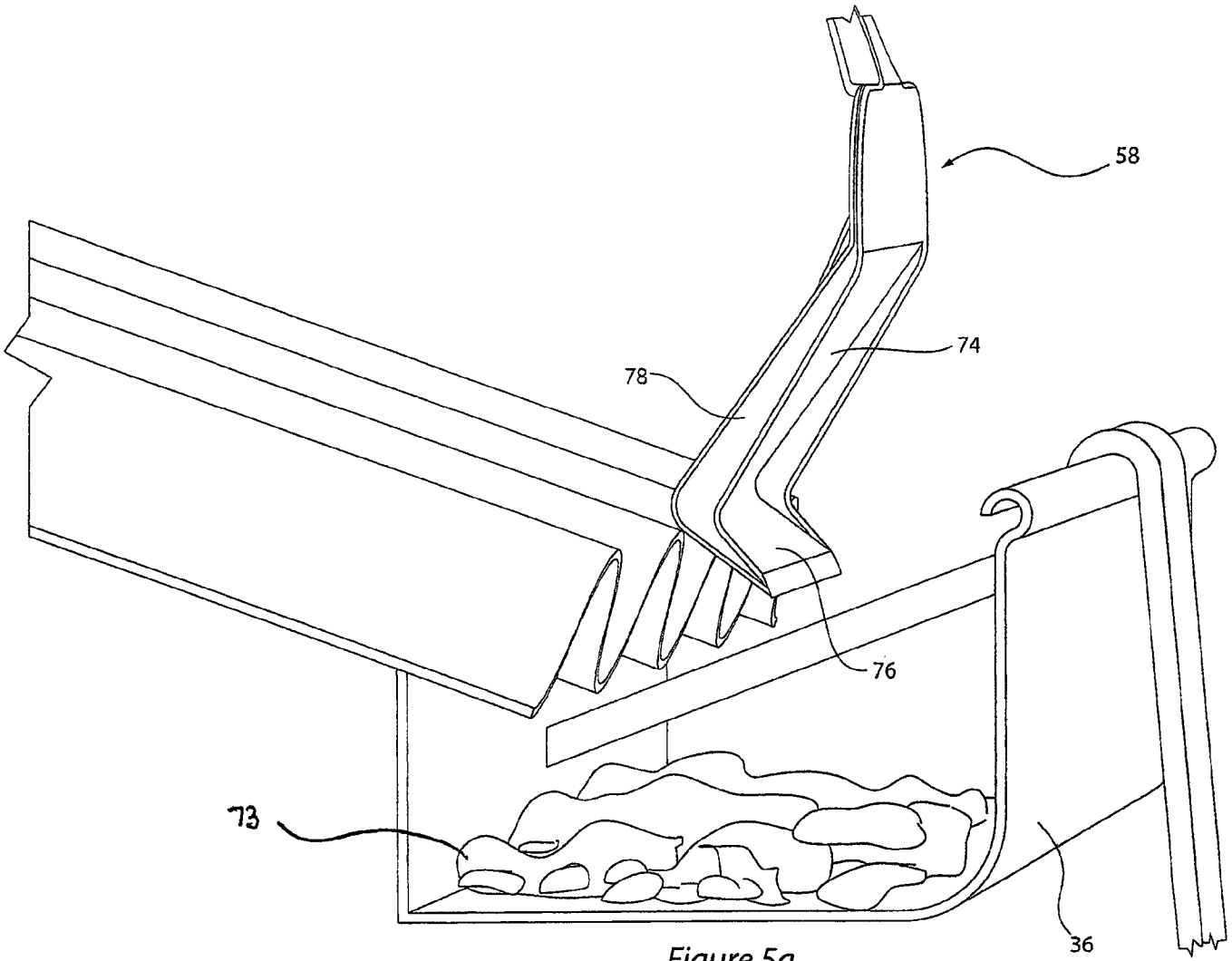
Figure 5B:
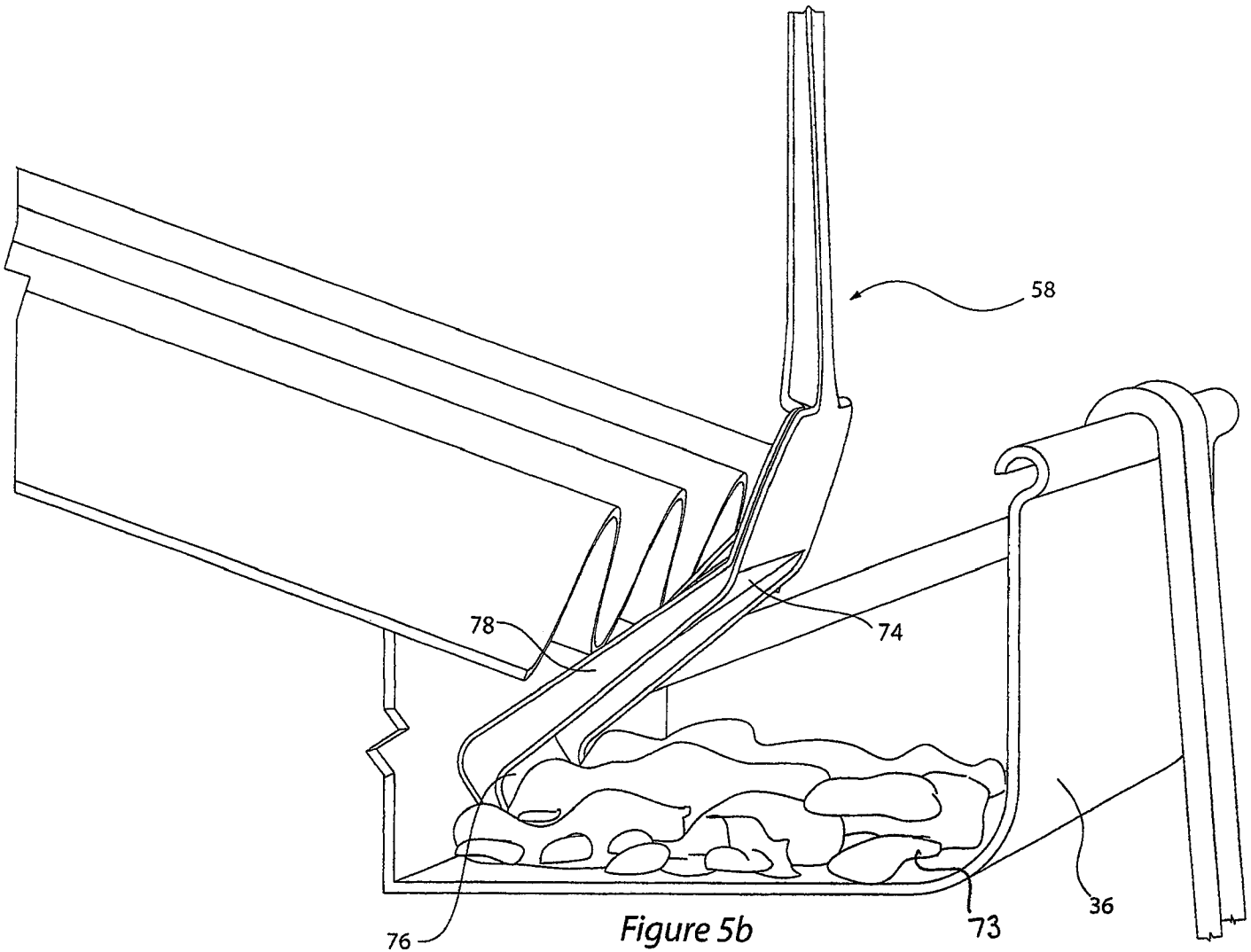
Figure 5C:
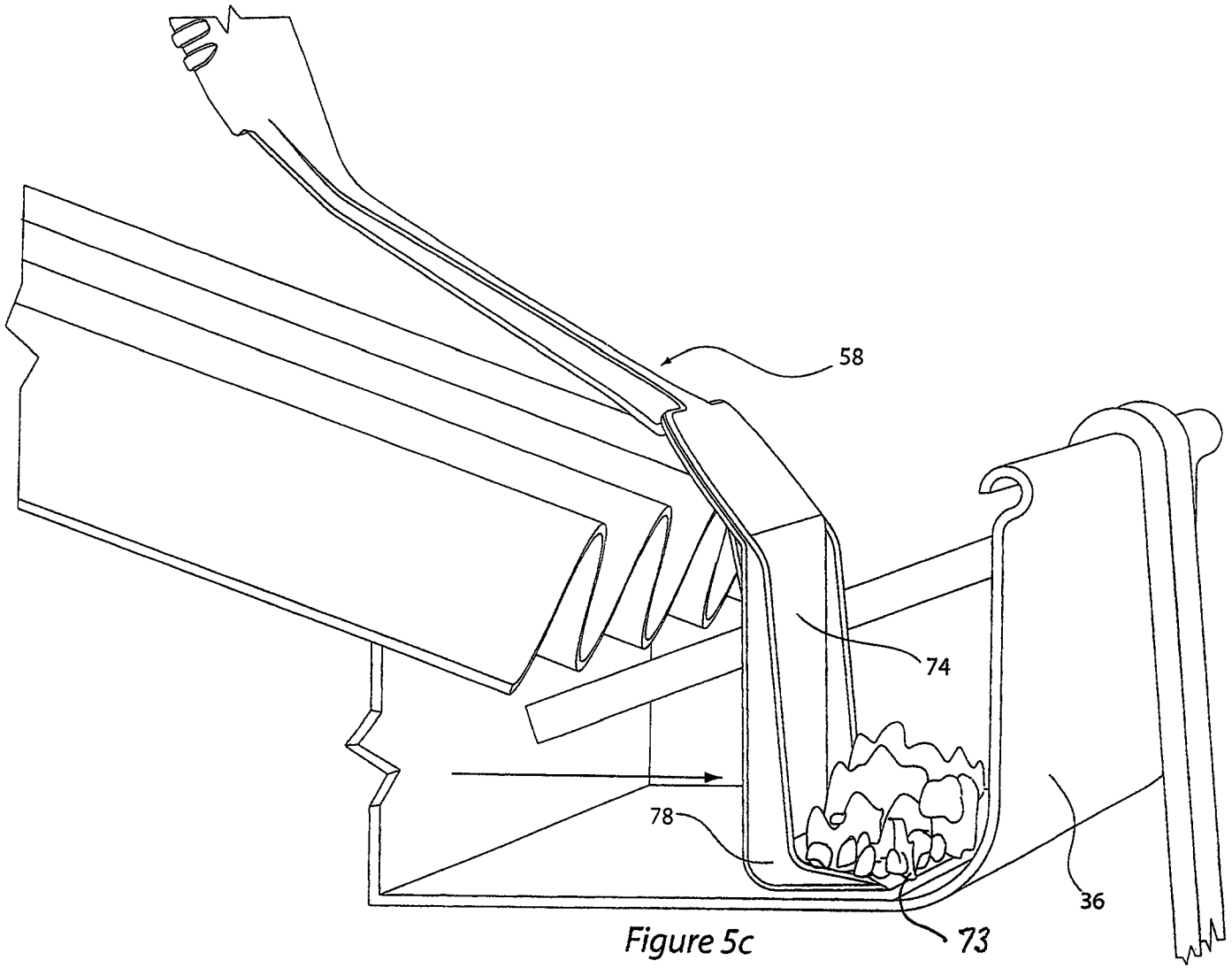
Figure 5D:
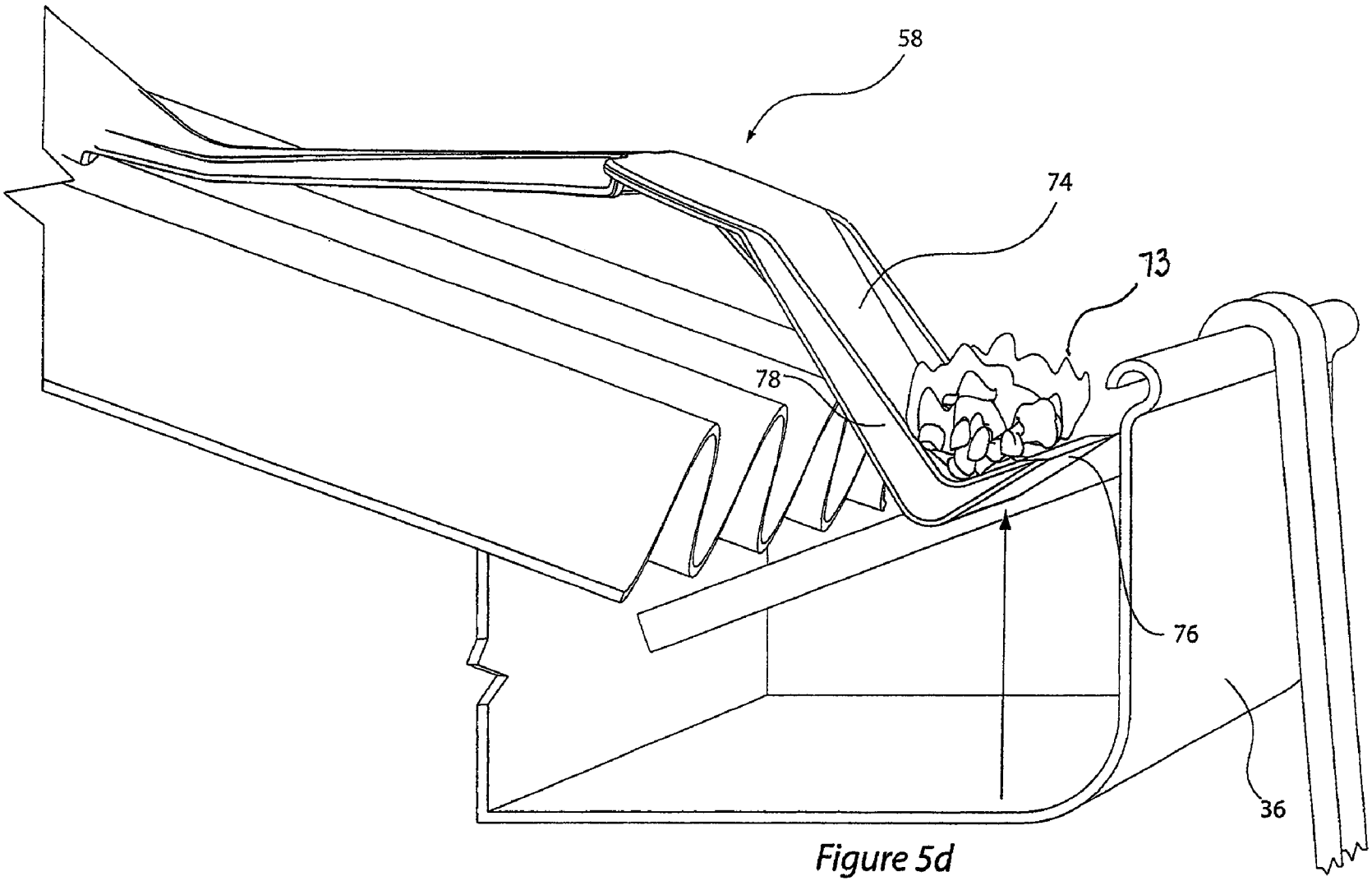
Figure 5E:
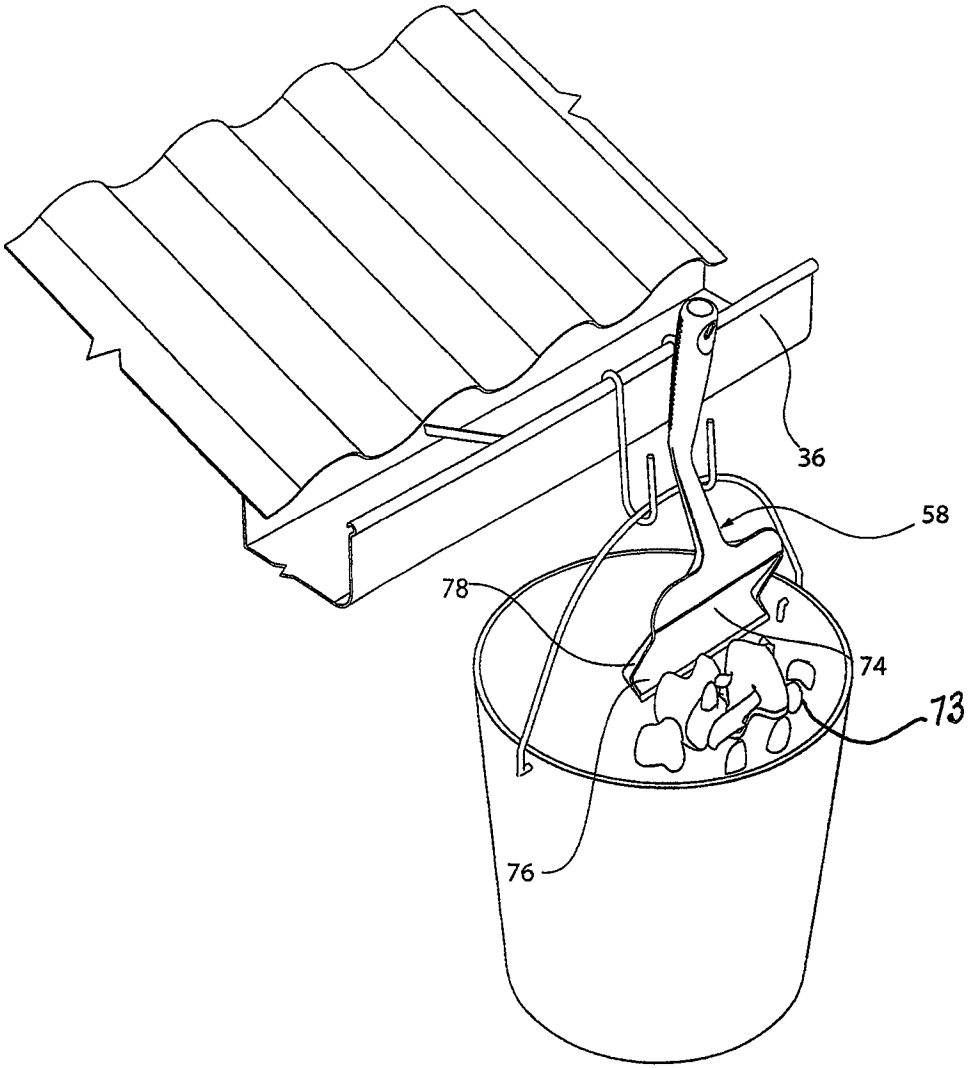

As can be seen from FIGS. 5*a* through to 5*e* the scoop 58 is first positioned to the rear of the gutter or to the roof side then lowered such that the base 76 can be scraped in and then be scooped across with the debris 73 being supported by the main backbone platform 74 as it was also assisted by the raised shoulder 78.

Figure 6:
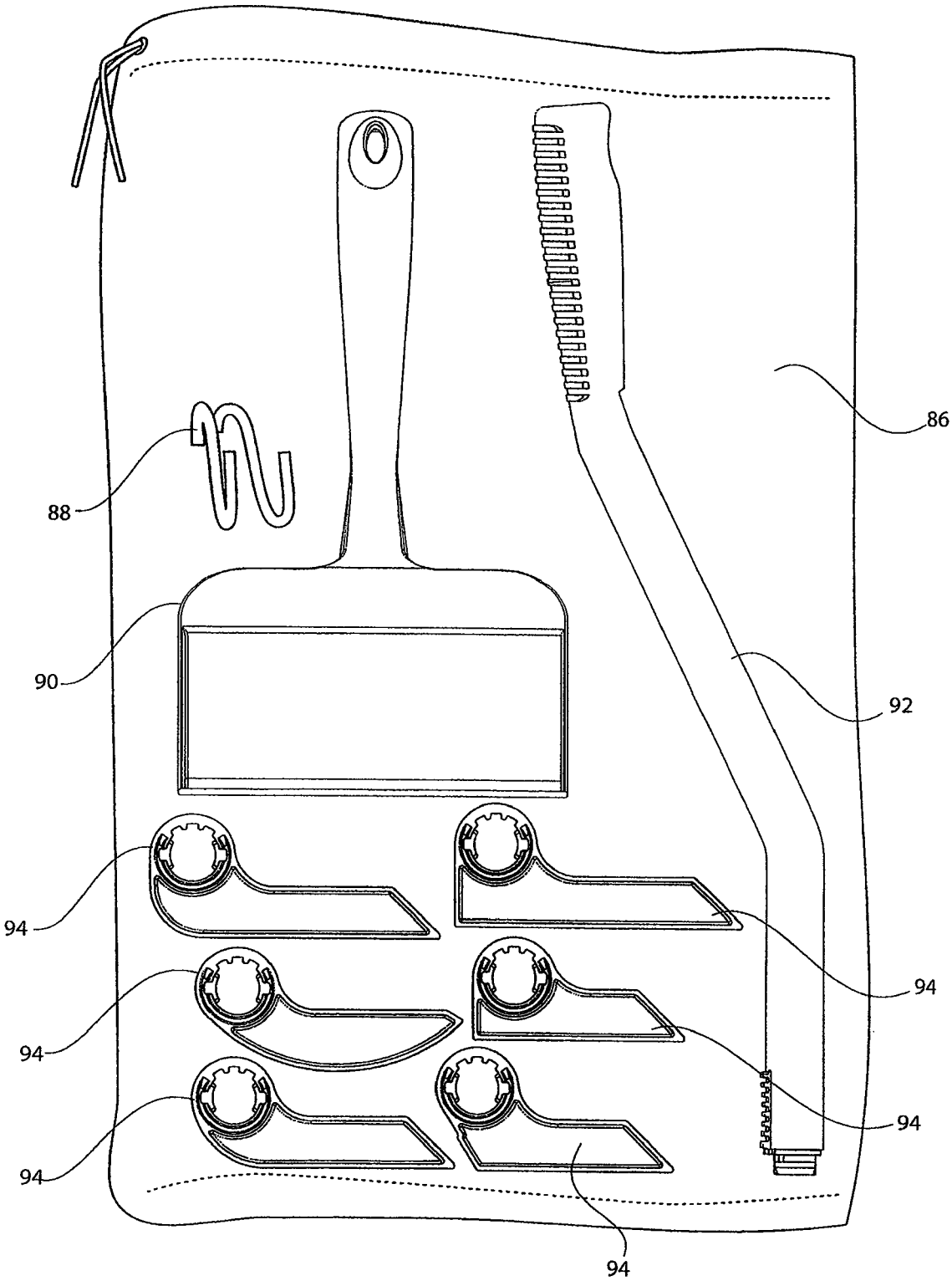
FIG. 6 shows a further preferred embodiment of the invention whereby the gutter cleaner tool is provided as a cleaning kit.

FIG. 6 shows a further preferred way in which the cleaning tool can be provided for and this is as a complete kit which would consist of the main hand held cleaning tool 92, a series of snap on heads or blades 94, the scoop at 90 as well as a wire holder 88 which can be used as an accessory to hold a bucket or the like as well as the positioning of the cleaning tool 92 and the scooper 90 also thereon.

The kit in FIG. 6 also includes a bag 86 which has to be expected can be presented in a variety of colours or represented imageries to make the overall kit more aesthetically pleasing for purchase by members of the purchasing public.

Figure 7:
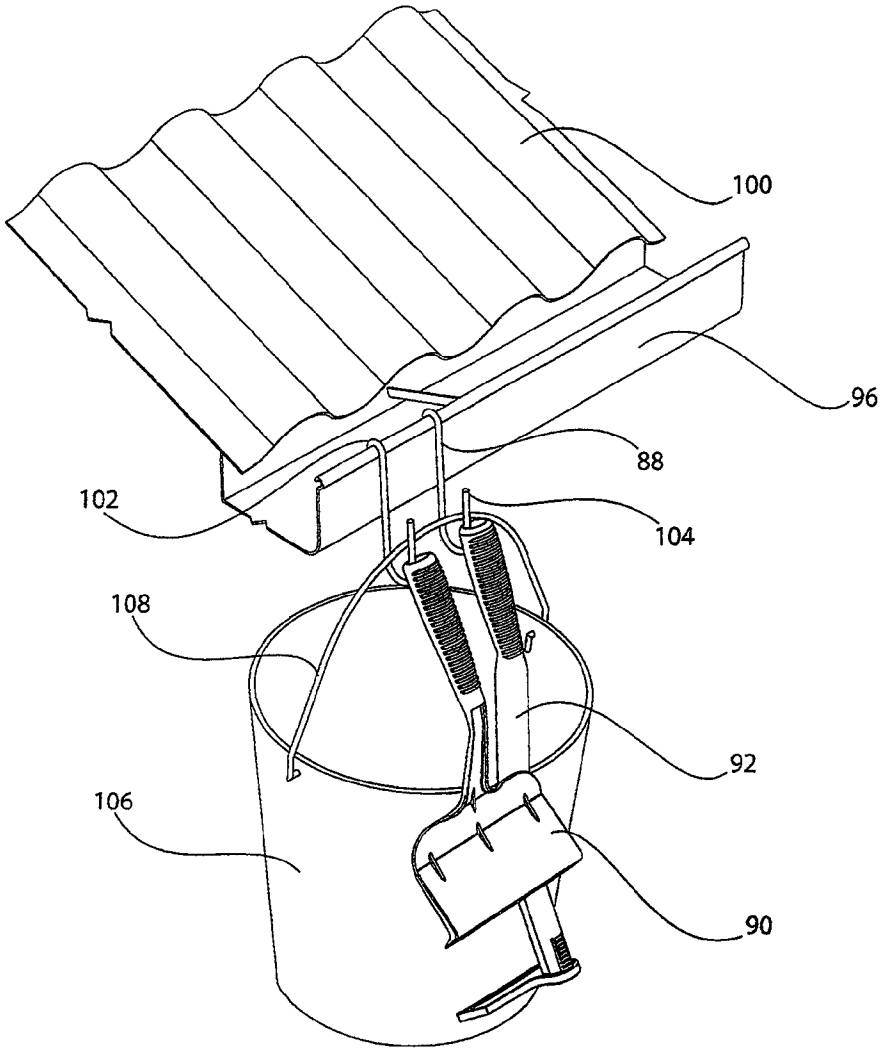
FIG. 7 shows a further preferred embodiment of the invention as to how the gutter cleaner kit may be positioned when the user prepares his or herself to commence cleaning of the gutter.

FIG. 7 shows one way in which the kit could be prepared for use upon the gutter wherein the wire holder 88 which includes its supports 102 which makes it available to be safely hooked onto the gutter 96 of the roof 100 whereby the upright arms 104 of the simple wire holder 88 can be used to secure a bucket 106 by hooking on the bucket 106 handles 108.

As the cleaning tool and scoop both may include apertures on their handles, these apertures on the handle are also adapted to be passed along the upright arms 104 of the wire holder 88 if such features need to be rested thereon.

The claims defining the invention are as follows:

1. A cleaning arrangement for removing accumulated leaves and other debris from an overhead gutter of a building, said arrangement including:

a cleaning tool having a blade of comparative cross sectional profile to the gutter to be cleaned, an elongated rod having one end adapted to be held by a user and a remote end substantially perpendicular to the said blade when said blade is connected to said rod, said blade including an aperture at an upper corner of said blade for an end of the rod to be releasable fastenable therein in an off-center positioning, such that the off-center positioning of the rod allows the cleaning tool to be scraped along the length of a segment of guttering without the blade making contact with internal brackets or bracing supporting the gutter, wherein the blade is connected to the rod by a biasing ribbed lever that is a part of the rod that extends into the aperture of the blade, wherein a shelf extending from the lever includes an upward tab that is adapted to be position into any one of a series of slots about the circumferential edge of the aperture, such that the rod is held in place in the aperture by the upward tab's engagement with one of the slots and with one of the ribs of the biasing lever.

2. The arrangement of claim 1 wherein the rod is divided by a first fold and a second fold, with the first fold defining upper and lower sections of the rod, and the second fold having a handle extending therefrom.

3. The arrangement of claim 1 wherein the blade is adapted to be fastenable to the rod substantially perpendicular either to the left or right hand sides of said rod so the blade may be reversed for either hand use of the user when cleaning the gutter.

4. The arrangement of claim 3 wherein said rod is formed from a single piece of molded reinforced plastic having a groove along its length thereby minimizing the amount of material utilized in the cleaning tool thereby keeping manufacturing costs and the weight of the cleaning tool significantly reduced.

5. The arrangement of claim 4 wherein the reinforced plastic is engineered grade polypropylene strengthened with glass fibre for long term strength, durability and ultra violet sunlight resistance.

6. The arrangement of claim 5 further including a scoop having a handle extending from a first fold, a length between first fold and a second fold, said second fold separating a shoulder folded with a platform, said platform having raised sides and connected to a base.

7. The arrangement of claim 6 further including a wire holder that hooks onto the gutter whereby upright arms of the wire holder support the handle of a bucket.

8. The arrangement of claim 7 wherein the cleaning tool or scoop or both the cleaning tool and scoop include apertures on their respective handles adapted to be passed along the upright arms of the wire holder to be rested thereon.

9. The arrangement of claim 8 wherein the rod includes a handle, wherein one end of the handle includes a hollow chamber to receive an extension rod, to increase the span of use of the cleaning tool when cleaning the gutter.

* * * * *